United States Patent [19]

Nagahiro et al.

[11] Patent Number: 4,727,830

[45] Date of Patent: Mar. 1, 1988

[54] VALVE OPERATING MECHANISM FOR INTERNAL COMBUSTION ENGINE

[75] Inventors: Kenichi Nagahiro; Yoshio Ajiki; Masaaki Katoh, all of Saitama; Kazuo Inoue, Tokyo, all of Japan

[73] Assignee: Honda Giken Kogyo Kabushiki Kaisha, Tokyo, Japan

[21] Appl. No.: 891,753

[22] Filed: Jul. 31, 1986

[30] Foreign Application Priority Data

Jul. 31, 1985 [JP] Japan ..... 60-168716
Jul. 31, 1985 [JP] Japan ..... 60-168714
Jul. 31, 1985 [JP] Japan ..... 60-168718

[51] Int. Cl.[4] ..... F01L 1/26
[52] U.S. Cl. ..... 123/90.16; 123/90.44
[58] Field of Search ..... 123/90.16, 90.39, 90.4, 123/90.41, 90.44, 198 F

[56] References Cited

U.S. PATENT DOCUMENTS 4,523,550 6/1985 Matsuura ..... 123/90.16
4,612,884 9/1986 Ajiki et al. ..... 123/90.16
4,656,977 4/1987 Magahiro et al. ..... 123/90.16

*Primary Examiner*—Tony M. Argenbright
*Attorney, Agent, or Firm*—Lyon & Lyon

[57] ABSTRACT

A valve operating mechanism includes a camshaft rotatable in synchronism with rotation of an internal combustion engine and having a plurality of cams of different cam profiles. First, second, and third rocker arms are held in sliding contact with the cams, respectively, for operating the valves according to the cam profiles of the cams. The rocker arms are selectively interconnected and disconnected by first and second selective couplings to operate the valves at different valve timings in low, medium, and high speed ranges of the internal combustion engine.

18 Claims, 16 Drawing Figures

VALVE OPERATING MECHANISM FOR INTERNAL COMBUSTION ENGINE

BACKGROUND OF THE INVENTION

The present invention relates to a valve operating mechanism for an internal combustion engine, including a camshaft rotatable in synchronism with the rotation of the internal combustion engine and having integral cams for operating a pair of intake or exhaust valves, and rocker arms angularly movably supported on a rocker shaft for opening and closing the intake or exhaust valves in response to rotation of the cams.

Valve operating mechanisms used in internal combustion engines are generally designed to meet requirements for high-speed operation of the engines. More specifically, the valve diameter and valve lift are selected not to exert substantial resistance to the flow of an air-fuel mixture which is introduced through a valve into a combustion chamber at a rate for maximum engine power.

If an intake valve is actuated at constant valve timing and valve lift throughout a full engine speed range from low to high speeds, then the speed of flow of an air-fuel mixture into the combustion chamber varies from engine speed to engine speed since the amount of air-fuel mixture varies from engine speed to engine speed. At low engine speeds, the speed of flow of the air-fuel mixture is lowered and the air-fuel mixture is subject to less turbulence in the combusion chamber, resulting in slow combustion therein. Therefore, the combustion efficiency is reduced and so is the fuel economy, and the knocking margin is lowered due to the slow combustion.

One solution to the above problems is disclosed in Japanese Laid-Open Patent Publication No. 59(1984)-226216. According to the disclosed arrangement, some of the intake or exhaust valves remain closed when the engine operates at a low speed, whereas all of the intake or exhaust valves are operated, i.e., alternately opened and closed, during high-speed operation of the engine. Therefore, the valves are controlled differently in low-and high-speed ranges.

SUMMARY OF THE INVENTION

It is an object of the present invention to provide a valve operating mechanism for an internal combustion engine, which controls valves in low-, medium-, and high-speed ranges for increased engine power and fuel economy.

According to the present invention, there is provided a valve operating mechanism for operating a pair of valves of an internal combustion engine, comprising a camshaft rotatable in synchronism with rotation of the internal combustion engine and having a plurality of cams of different cam profiles, a plurality of rocker arms held in sliding contact with the cams, respectively, for operating the valves according to the cam profiles of the cams, and means for selectively interconnecting and disconnecting the rocker arms to operate the valves at different valve timings in low, medium, and high speed ranges of the internal combustion engine.

In one preferred embodiment of the present invention, the cams include a low-speed cam and a high-speed cam having a cam lobe larger than the cam lobe of the low-speed cam, the camshaft also having a circular raised portion corresponding to a base circle of the low- and high-speed cams, the high-speed cam being disposed between the low-speed cam and the raised portion, the rocker arms including first, second, and third rocker arms slidably held against the high-speed cam, the low-speed cam, and the raised portion, respectively, the second and third rocker arms having ends for engagement with the intake valves, respectively.

In another preferred embodiment, the cams include a low-speed cam and a high-speed cam having a cam lobe larger than the cam lobe of the low-speed cam, the camshaft also having a circular raised portion corresponding to a base circle of the low- and high-speed cams, the raised portion being disposed between the low-speed cam and the high-speed cam, the rocker arms including first, second, and third rocker arms slidably held against the raised portion, the low-speed cam, and the high-speed cam, respectively, the first and second rocker arms having ends for engagement with the intake valves, respectively.

In still another preferred embodiment the cams include a first low-speed cam, a second low-speed cam having a cam lobe of a different profile from the profile of the cam lobe of the first low-speed cam, and a high-speed cam having a cam lobe larger than the cam lobes of the first and second low-speed cams and disposed between the first and second low-speed cams, the rocker arms including first, second, and third rocker arms slidably held against the high-speed cam, the first low-speed cam, and the second high-speed cam, respectively, the first and third rocker arms having ends for engagement with the intake valves, respectively.

In each of the preferred embodiments, means are provided for selectively interconnecting and disconnecting the rocker arms. Specifically, the means comprise a first selective coupling operatively disposed in and between the first and second rocker arms for selectively interconnecting and disconnecting the first and second rocker arms, and a second selective coupling operatively disposed in and between the first and third rocker arms for selectively interconnecting and disconnecting the first and third rocker arms, the first and second selective couplings being operable independently of each other.

In the selective coupling means of each of the preferred embodiments, the first selective coupling comprises a first guide hole defined in the first rocker arm, a second guide hole defined in the second rocker arm in registration with the first guide hole, a first piston slidably fitted in the first guide hole, a first spring disposed in the second guide hole for normally urging the first piston into the first guide hole, and first means for applying hydraulic pressure to the first piston to move the same to a position between the first and second guide holes against the resiliency of the first spring. The second selective coupling comprises a third guide hole defined in the first rocker arm, a fourth guide hole defined in the third rocker arm in registration with the third guide hole, a second piston slidably fitted in the third guide hole, a second spring disposed in the fourth guide hole for normally urging the second piston into the third guide hole, and second means for applying hydraulic pressure to the second piston to move the same to a position between the third and fourth guide holes against the resiliency of the second spring.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
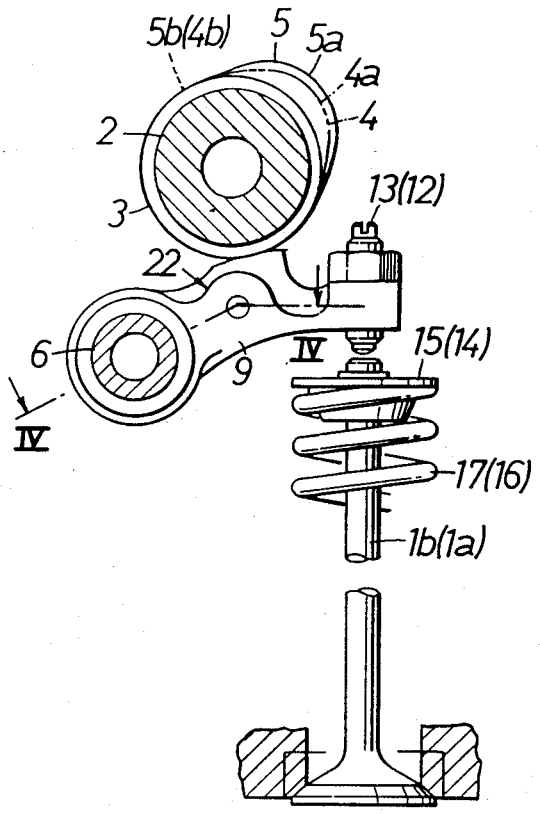
FIG. 1 is a vertical cross-sectional view of a valve operating mechanism according to an embodiment of the present invention, the view being taken along line I—I of FIG. 2.

Like or corresponding parts are denoted by like or corresponding reference characters throughout the views.

Figure 2:
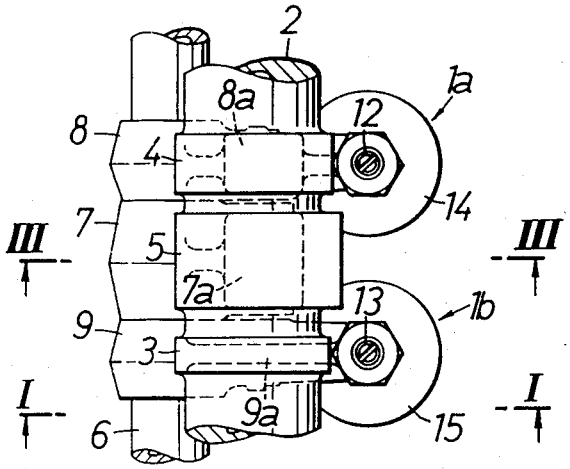
FIG. 2 is a plan view of the valve operating mechanism shown in FIG. 1.

FIGS. 1 and 2 show a valve operating mechanism according to an embodiment of the present invention. The valve operating mechanism is incorporated in an internal combustion engine including a pair of intake valves 1*a*, 1*b* in each engine cylinder for introducing an air-fuel mixture into a combustion chamber defined in an engine body.

The valve operating mechanism comprises a camshaft 2 rotatable in synchronism with rotation of the engine at a speed ratio of ½ with respect to the speed of rotation of the engine crankshaft. The camshaft 2 has an annular raised portion 3, a low-speed cam 4, and a high-speed cam 5 which are integrally disposed on the circumference of the camshaft 2. The valve operating mechanism also has a rocker shaft 6 extending parallel to the camshaft 2, and first through third rocker arms 7, 8, 9 angularly movably supported on the rocker shaft 6 and held against the high-speed cam 5, the low-speed cam 4, and the raised portion 3, respectively, on the camshaft 2. The intake valves 1*a*, 1*b* are selectively operated by the first through third rocker arms 7, 8, 9 actuated by the low- and high-speed cams 4, 5.

The camshaft 2 is rotatably disposed above the engine body. The high-speed cam 5 is disposed in a position corresponding to an intermediate position between the intake valves 1*a*, 1*b*, as viewed in FIG. 2. The low-speed cam 4 and the raised portion 3 are disposed one on each side of the high-speed cam 5. The raised portion 3 has a circumferential profile in the shape of a circle corresponding to the base circles 4*b*, 5*b* of the low- and high-speed cams 4, 5. The low-speed cam 4 has a cam lobe 4*a* projecting radially outwardly from the base circle 4*b*, and the high-speed cam 5 has a cam lobe 5*a* projecting radially outwardly from the base circle 5*b* to a greater extent than the cam lobe 4*a*, with the cam lobe 5*a* also having a larger angular extent than the cam lobe 4*a*.

The rocker shaft 6 is fixed below the camshaft 2. The first rocker arm 7 pivotally supported on the rocker shaft 6 is aligned with the high-speed cam 5, the second rocker arm 8 pivotally supported on the rocker arm 6 is aligned with the low-speed cam 4, and the third rocker arm 9 pivotally supported on the rocker arm 6 is aligned with the raised portion 3. The rocker arms 7, 8, 9 have on their upper surfaces cam slippers 7*a*, 8*a*, 9*a*, respectively, held in sliding contact with the cams 4, 5 and the raised portion 3, respectively. The second and third rocker arms 8, 9 have distal ends positioned above the intake valves 1*a*, 1*b*, respectively. Tappet screws 12, 13 are threaded through the distal ends of the second and third rocker arms 8, 9 and have tips engagable respectively with the upper ends of the valve stems of the intake valves 1*a*, 1*b*.

Flanges 14, 15 are attached to the upper ends of the valve stems of the intake valves 1*a*, 1*b*. The intake valves 1*a*, 1*b* are normally urged to close the intake ports by compression coil springs 16, 17 disposed under compression around the valve stems between the flanges 14, 15 and the engine body.

Figure 3:
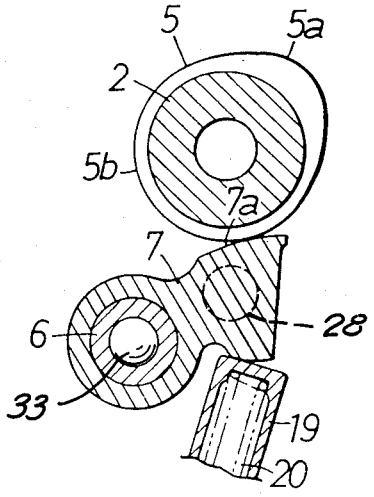
FIG. 3 is a cross-sectional view taken along line III—III of FIG. 2.

As shown in FIG. 3, a bottomed cylindrical lifter 19 is disposed in abutment against a lower surface of the first rocker arm 7. The lifter 19 is normally urged upwardly by a compression spring 20 of relatively weak resiliency interposed between the lifter 19 and the engine body for resiliently biasing the cam slipper 7*a* of the first rocker arm 7 slidably against the high-speed cam 5.

Figure 4:
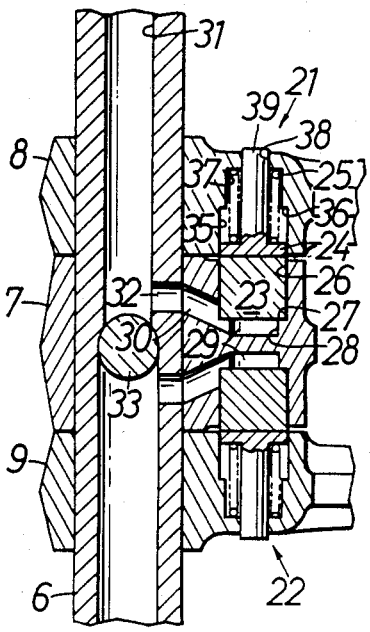
FIG. 4 is a cross-sectional view taken along line IV—IV of FIG. 1, showing first through third rocker arms disconnected from each other.

As illustrated in FIG. 4, the first and second rocker arms 7, 8 have confronting side walls held in sliding contact with each other. A first selective coupling 21 is operatively disposed in and between the first and second rocker arms 7, 8 for selectively disconnecting the rocker arms 7, 8 from each other for relative displacement and also for interconnecting the rocker arms 7, 8 for their movement in unison. Likewise, the first and third rocker arms 7, 9 have confronting side walls held in sliding contact with each other. A second selective coupling 22 is operatively disposed in and between the first and third rocker arms 7, 9 for selectively disconnecting the rocker arms 7, 9 from each other for relative displacement and also for interconnecting the rocker arms 7, 9 for their movement in unison.

The first and second selective couplings 21, 22 are of an identical construction, and hence only the first selective coupling 21 will hereinafter be described in detail.

The first selective coupling 21 comprises a piston 23 movable between a position in which it interconnects the first and second rocker arms 7, 8 and a position in which it disconnects the first and second rocker arms 7, 8 from each other, a circular stopper 24 for limiting the movement of the piston 23, and a coil spring 25 for urging the stopper 24 to move the piston 23 toward the position to disconnect the first and second rocker arms 7, 8 from each other.

The first rocker arm 7 has a first guide hole 26 opening toward the second rocker arm 8 and extending parallel to the rocker shaft 6. The first rocker arm 7 also has a smaller-diameter hole 28 near the closed end of the first guide hole 26, with a step or shoulder 27 being defined between the smaller-diameter hole 28 and the first guide hole 26. The piston 23 is slidably fitted in the first guide hole 26. The piston 23 and the closed end of the smaller-diameter hole 28 define therebetween a hydraulic pressure chamber 29.

The first rocker arm 7 has a hydraulic passage 30 defined therein in communication with the hydraulic pressure chamber 29. The rocker shaft 6 has a hydraulic passage 31 defined axially therein and coupled to a source (not shown) of hydraulic pressure through a suitable hydraulic pressure control mechanism. The hydraulic passages 30, 31 are held in communication with each other through a hole 32 defined in a side wall of the rocker shaft 6, irrespective of how the first rocker arm 7 is angularly moved about the rocker shaft 6.

The second rocker arm 8 has a second guide hole 35 opening toward the first rocker arm 7 in registration with the first guide hole 26 in the first rocker arm 7. The circular stopper 24 is slidably fitted in the second guide hole 35. The second rocker arm 8 also has a smaller-diameter hole 37 near the closed end of the second guide hole 35, with a step or shoulder 36 defined between the second guide hole 35 and the smaller-diameter hole 37 for limiting movement of the circular stopper 24. The second rocker arm 8 also has a through hole 38 defined coaxially with the smaller-diameter hole 37. A guide rod 39 joined integrally and coaxially to the circular stopper 24 extends through the hole 38. The coil spring 25 is disposed around the guide rod 39 between the stopper 24 and the closed end of the smaller-diameter hole 37.

The piston 23 has an axial length selected such that when one end of the piston 23 abuts against the step 27, the other end thereof is positioned just between and hence lies flush with the sliding side walls of the first and second rocker arms 7, 8, and when the piston 23 is moved into the second guide hole 35 until it displaces the stopper 24 into abutment against the step 36, said one end of the piston 23 remains in the first guide hole 26 and hence the piston 23 extends between the first and second rocker arms 7, 8.

The hydraulic passages 31 communicating with the first and second selective couplings 21, 22 are isolated from each other by a steel ball 33 forcibly fitted and fixedly positioned in the rocker shaft 6. Therefore, the first and second selective couplings 21, 22 are operable under hydraulic pressure independently of each other.

Operation of the valve operating mechanism will be described with reference to FIGS. 4 through 6. When the engine is to operate in a low-speed range, the first and second selective couplings 21, 22 are actuated to disconnect the first through third rocker arms 7, 8, 9 from each other as illustrated in FIG. 4. More specifically, the hydraulic pressure is released by the hydraulic pressure control mechanism from the hydraulic pressure chamber 29, thus allowing the stopper 24 to move toward the first rocker arm 7 under the resiliency of the spring 25 until the piston 23 abuts against the step 27. When the piston 23 engages the step 27, the mutually contacting ends of the piston 23 and the stopper 24 of the first selective coupling 21 lie flush with the sliding side walls of the first and second rocker arms 7, 8. Likewise, the mutually contacting ends of the piston 23 and the stopper 24 of the second selective coupling 22 lie flush with the sliding side walls of the first and third rocker arms 7, 9. Thus, the first, second, and third rocker arms 7, 8, 9 are held in mutually sliding contact for relative angular movement.

With the first through third rocker arms 7, 8, 9 being thus disconnected, the second and third rocker arms 8, 9 are not affected by the angular movement of the first rocker arm 7 in sliding contact with the high-speed cam 5. The second rocker arm 8 is angularly moved in sliding contact with the low-speed cam 4, whereas the third rocker arm 9 is not angularly moved since the circular circumferential surface of the raised portion 3 does not impose any camming action on the third rocker arm 9. Therefore, the intake valve 1*a* is alternately opened and closed by the second rocker arm 8, and the other intake valve 1*b* remains closed. Any frictional loss of the valve operating mechanism is relatively low because the first rocker arm 7 is held in sliding contact with the high-speed cam 5 under the relatively small resilient force of the spring 20.

During low-speed operation of the engine, therefore, the intake valve 1*a* alternately opens and closes the intake port at the valve timing and valve lift according to the profile of the low-speed cam 4, whereas the other intake valve 1*b* remains at rest. Accordingly, the air-fuel mixture flows into the combustion chamber at a rate suitable for the low-speed operation of the engine, resulting in improved fuel economy and prevention of knocking. Since the other intake valve 1*b* remains at rest, the turbulence of the air-fuel mixture in the combustion chamber is increased for greater resistance against a reduction in the density of the air-fuel mixture. This helps improve fuel economy.

Figure 5:
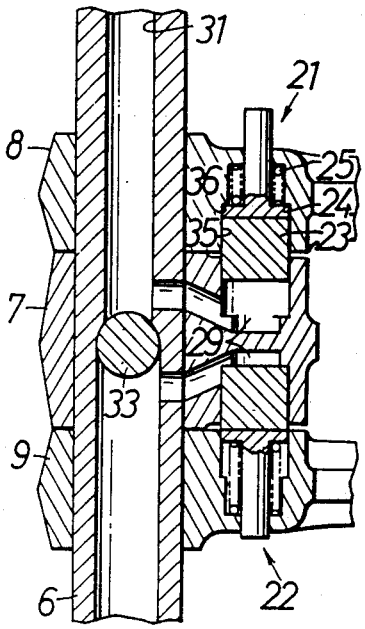
FIG. 5 is a cross-sectional view similar to FIG. 4, showing the first and second rocker arms connected to each other.

For medium-speed operation of the engine, the first and second rocker arms 7, 8 are interconnected by the first selective coupling 21, with the first and third rocker arms 7, 9 remaining disconnected from each other, as shown in FIG. 5. More specifically, the hydraulic pressure chamber 29 of the first selective coupling 21 is supplied with hydraulic pressure to cause the piston 23 to push the stopper 24 into the second guide hole 35 against the resiliency of the spring 25 until the stopper 24 engages the step 36. The first and second rocker arms 7, 8 are now connected to each other for angular movement in unison.

Therefore, the intake valve 1*a* alternately opens and closes the intake port at the valve timing and valve lift according to the profile of the high-speed cam 5, whereas the other intake valve 1*b* remains at rest. The air-fuel mixture now flows into the combustion chamber at a rate suitable for the medium-speed operation of the engine, resulting in greater turbulence of the air-fuel mixture in the combustion chamber and hence in improved fuel economy.

Figure 6:
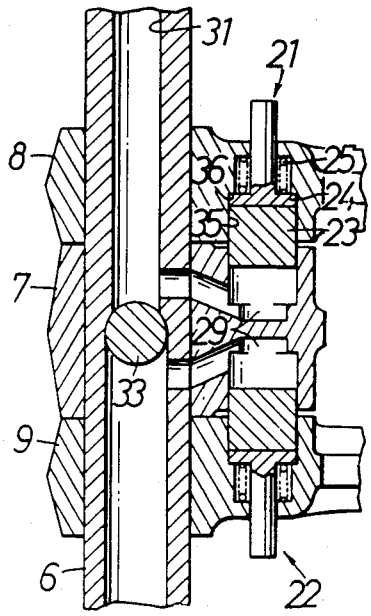
FIG. 6 is a cross-sectional view similar to FIG. 4, showing the first through third rocker arms connected to each other.

When the engine is to operate at a high speed, the first and third rocker arms 7, 9 are interconnected by the second selective coupling 22, as shown in FIG. 6, by supplying hydraulic pressure into the hydraulic-pressure chamber 29 of the second selective coupling 22. Inasmuch as the first and second rocker arms 7, 8 remain connected by the first selective coupling 21 at this time, the rocker arms 7, 8, 9 are caused to swing by the high-speed cam 5. As a consequence, the intake valves 1*a*, 1*b* alternately open and close the respective intake ports at the valve timing and valve lift according to the profile of the high-speed cam 5. The intake efficiency is increased to enable the engine to produce higher output power and torque.

Figure 7:
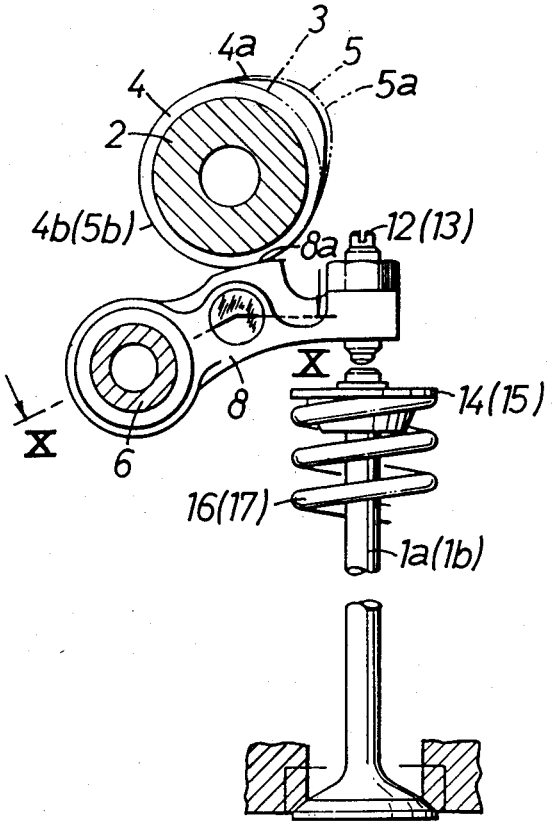
FIG. 7 is a vertical cross-sectional view of a valve operating mechanism according to another embodiment of the present invention, the view being taken along line VII—VII of FIG. 8.
Figure 8:
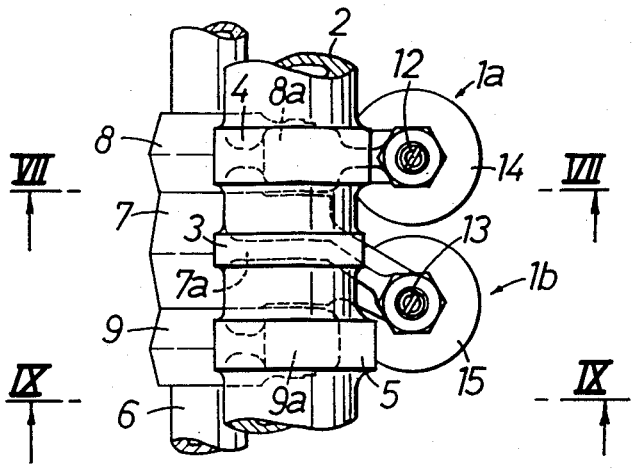
FIG. 8 is a plan view of the valve operating mechanism shown in FIG. 7.
Figure 9:
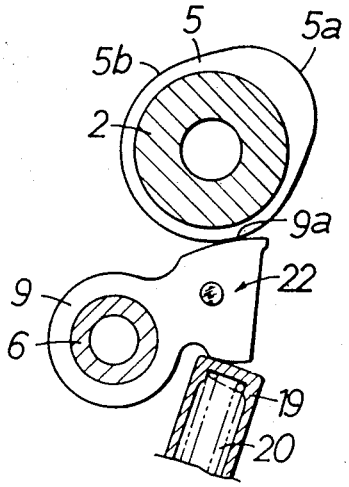
FIG. 9 is a cross-sectional view taken along line IX—IX of FIG. 8.

FIGS. 7, 8, and 9 illustrate a valve operating mechanism according to another embodiment of the present invention. The valve operating mechanism shown in FIGS. 7 and 8 essentially differs from the valve operating mechanism shown in FIGS. 1 and 2 in that the intake valves 1*a*, 1*b* are operated by the first and second rocker arms 7, 8, respectively, and the raised portion 3 is disposed axially between the low- and high-speed cams 4, 5 on the camshaft 2. The cam slipper 7*a* of the first rocker arm 7 is held in sliding contact with the raised portion 3. As illustrated in FIG. 9, the third rocker arm 9 which does not operate on any intake valve is normally urged by the lifter 19 to cause its cam slipper 9*a* to be held in sliding engagement with the high-speed cam 5.

Figure 10:
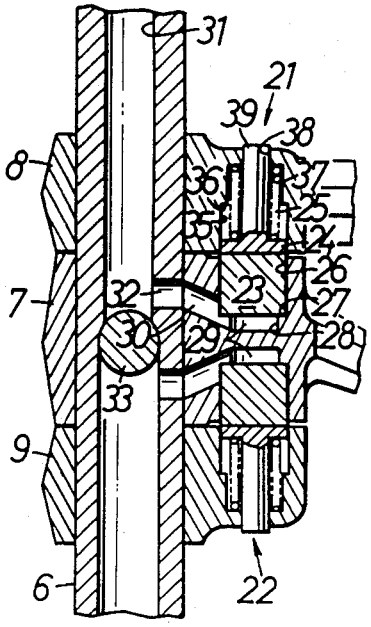
FIG. 10 is a cross-sectional view taken along line X—X of FIG. 7, showing first through third rocker arms disconnected from each other.

As shown in FIG. 10, the first and second selective couplings 21, 22 which are incorporated in the first through third rocker arms 7, 8, 9 are identical to those shown in FIG. 4, and the hydraulic systems associated with these selective couplings 21, 22 are also identical to those shown in FIG. 4.

Operation of the valve operating mechanism illustrated in FIGS. 7 through 9 will be described with reference to FIGS. 10 through 12. For operating the engine at a low speed, the first through third rocker arms 7, 8, 9 are disconnected by the first and second selective couplings 21, 22. That is, the hydraulic chambers 29 are released of hydraulic pressure to permit the stoppers 24 to be moved toward the first rocker arm 7 under the resiliency of the springs 25, and the pistons 23 are retracted by the stoppers 24 until the pistons 23 engage the respective steps 27. The pistons 23 are now positioned completely out of the second guide holes 35 in the second and third rocker arms 7, 9, and the first, second, and third rocker arms 7, 8, 9 are angularly movable relatively to each other in mutually sliding contact.

The first rocker arm 7 as it engages the circular raised portion 3 is not angularly moved, so that the intake valve 1*b* is held at rest. Since the second rocker arm 8 is swung by the low-speed cam 4, the intake valve 1*a* alternately opens and closes the intake port at the valve timing and valve lift according to the cam profile of the low-speed cam 4. Therefore, only the intake valve 1*a* is operated by the low-speed cam 4 during low-speed operation of the engine.

Figure 11:
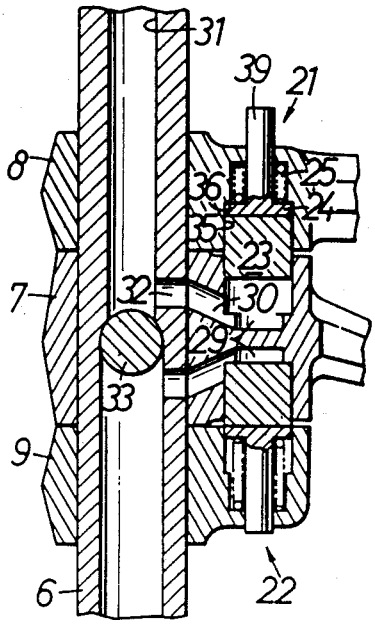
FIG. 11 is a cross-sectional view similar to FIG. 10, showing the first and second rocker arms connected to each other.

For operating the engine at a medium speed, the first and second rocker arms 7, 8 are interconnected by the first selective coupling 21, whereas the first and third rocker arms 7, 9 remain disconnected from each other, as shown in FIG. 11. More specifically, hydraulic pressure is exerted in the hydraulic-pressure chamber 29 of the first selective coupling 21 to cause the piston 23 to push the stopper 24 into the second guide hole 35 against the resiliency of the spring 25 until the stopper 24 engages the step 36. The first and second rocker arms 7, 8 are now connected to each other for movement in unison.

Therefore, the intake valves 1*a*, 1*b* alternately open and close the respective intake ports at the valve timing and valve lift according to the profile of the low-speed cam 4. The air-fuel mixture now flows into the combustion chamber at a rate suitable for the medium-speed operation of the engine, resulting in improved fuel economy.

Figure 12:
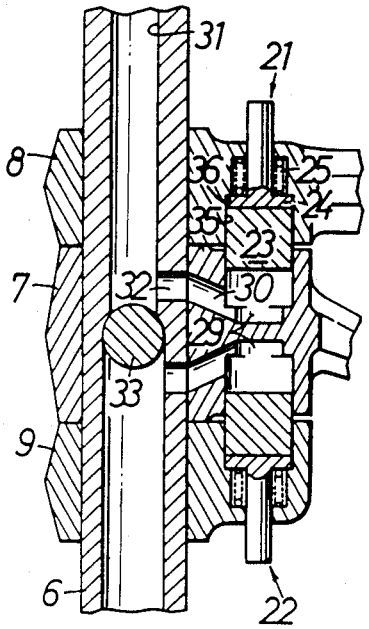
FIG. 12 is a cross-sectional view similar to FIG. 10, showing the first through third rocker arms connected to each other.

When the engine is to operate at a high speed, the first and third rocker arms 7, 9 are interconnected by the second selective coupling 22, as shown in FIG. 12, by supplying hydraulic pressure into the hydraulic-pressure chamber 29 of the second selective coupling 22. Since the first and second rocker arms 7, 8 have already been connected by the first selective coupling 21, the rocker arms 7, 8, 9 are caused to swing in unison by the high-speed cam 5. As a consequence, the intake valves 1*a*, 1*b* alternately open and close the respective intake ports at the valve timing and valve lift according to the profile of the high-speed cam 5.

Figure 13:
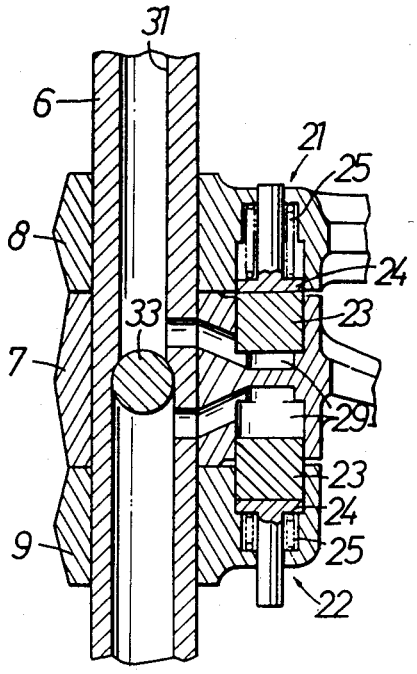
FIG. 13 is a cross-sectional view similar to FIG. 10, illustrating another mode of operation of the valve operating mechanism of FIG. 7.

FIG. 13 shows another mode of operation of the valve operating mechanism shown in FIGS. 7 through 9. In FIG. 13, for medium-speed operation of the engine, the first and second rocker arms 7, 8 are disconnected from each other by the first selective coupling 21, whereas the first and third rocker arms 7, 9 are interconnected by the second selective coupling 22. Therefore, the intake valve 1*a* is caused by the second rocker arm 8 to alternately open and close the intake port at the valve timing and valve lift according to the profile of the low-speed cam 4. On the other hand, the intake valve 1*b* alternately opens and closes the intake port at the valve timing and valve lift according to the profile of the high-speed cam 5. In this mode of operation, the air-fuel mixture in the combustion chamber will become turbulent for improved fuel economy.

Figure 14:
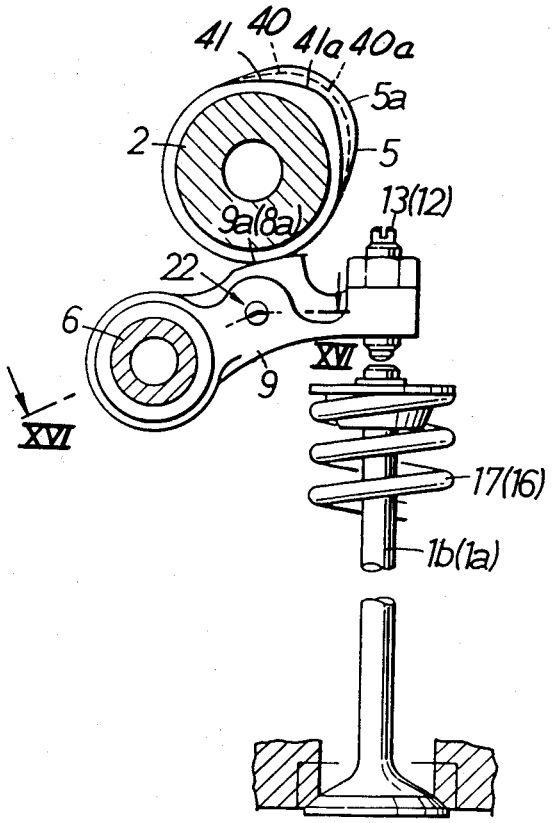
FIG. 14 is a vertical cross-sectional view of a valve operating mechanism according to still another embodiment of the present invention, the view being taken along line XIV—XIV of FIG. 15.
Figure 15:
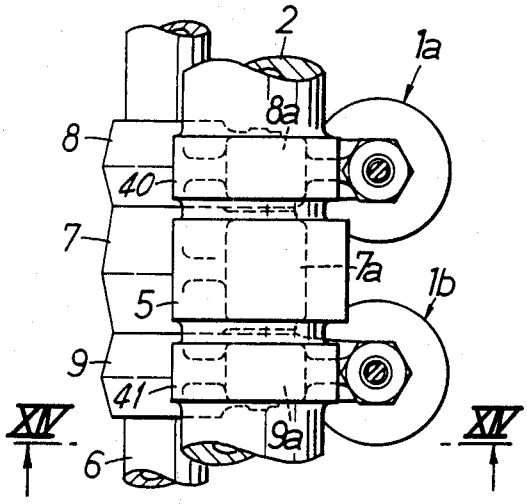
FIG. 15 is a plan view of the valve operating mechanism shown in FIG. 14.

FIGS. 14 and 15 illustrate a valve operating mechanism according to still another embodiment of the present invention. The valve operating mechanism shown in FIGS. 14 and 15 are similar to that of FIGS. 1 and 2 except that the camshaft 2 has a first low-speed cam 40, the high-speed cam 5, and a second low-speed cam 41 which are integral with the camshaft 2. The first, second, and third rocker arms 7, 8, 9 are held in sliding engagement with the high-speed cam 5, the first low-speed cam 40, and the second low-speed cam 41, respectively.

The first low-speed cam 40 has a cam lobe 40*a* projecting radially outwardly from the camshaft 2. The cam lobe 5*a* of the high-speed cam 5 is higher and of a larger angular extent than the cam lobe 40*a* of the first low-speed cam 40. The second low-speed cam 41 has a cam lobe 41*a* projecting radially outwardly from the camshaft 2 to an extent smaller than that of the cam lobe 40*a* of the first low-speed cam 40.

The first through third rocker arms 7, 8, 9 shown in FIG. 15 incorporate therein first and second selective couplings which are identical to those shown in FIG. 4, and hydraulic systems associated with these selective couplings are also identical to those shown in FIG. 4.

Therfore, operation of the valve operating mechanism illustrated in FIGS. 14 and 15 will be described with reference to FIGS. 4 through 6. For low-speed operation the engine, the first, second, and third rocker arms 7, 8, 9 are disconnected as shown in FIG. 4. The second rocker arm 8 is angularly moved in sliding contact with the first low-speed cam 40 to operate the intake valve 1*a*, whereas the third rocker arm 9 is angularly moved in sliding contact with the second low-speed cam 41 to operate the intake valve 1*b*. Therefore, the intake valve 1*a* alternately opens and closes the intake port at the valve timing and valve lift according to the profile of the first low-speed cam 40, and the other intake valve 1*b* alternately opens and closes the intake port at the valve timing and valve lift according to the profile of the second low-speed cam 41. The air-fuel mixture is allowed to flow into the combustion chamber at a rate optimum for the low-speed operation of the engine to improve fuel economy and prevent knocking. Since the low-speed cams 40, 41 have different cam profiles, the air-fuel mixture flowing through the intake valves 1*a*, 1*b* is subject to increased turbulence for further improvement of fuel economy. Inasmuch as the intake valves 1*a*, 1*b* are not held at rest, no carbon deposit will be formed between the intake valves 1*a*, 1*b* and their valve seats, thereby preventing a reduction in the sealing capability of the intake valves 1*a*, 1*b*, and also fuel will not be accumulated on the intake valves 1*a*, 1*b*.

For medium-speed operation of the engine, the first and second rocker arms 7, 8 are interconnected by the first selective coupling 21, and the first and third rocker arms 7, 9 are disconnected by the second selective coupling 22, as shown in FIG. 5. The intake valve 1*a* alternately opens and closes the intake port at the valve timing and valve lift according to the profile of the high-speed cam 5, and the other intake valve 1*b* alternately opens and closes the intake port at the valve timing and valve lift according to the profile of the second low-speed cam 41. The air-fuel mixture now flows into the combustion chamber at a rate optimum for the medium-speed operation of the engine, and is subject to large turbulence in the combustion chamber, for improved fuel economy.

To operate the engine at a high speed, the first, second, and third rocker arms 7, 8, 9 are interconnected by the first and second selective couplings 21, 22 as shown in FIG. 6. Consequently, the rocker arms 7, 8, 9 are swung by the high-speed cam 5. The intake valves 1*a*, 1*b* are operated to alternately open and close the respective intake valves at the valve timing and valve lift according to the profile of the high-speed cam 5, so that the intake efficiency is increased for higher engine output power and torque.

Figure 16:
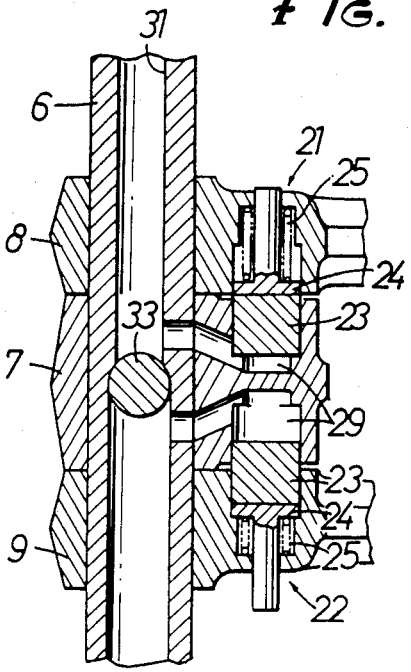
FIG. 16 is a cross-sectional view taken along line XVI—XVI of FIG. 14, showing one mode of operation of the valve operation of the valve operating mechanism of FIG. 14.

FIG. 16 is illustrative of still another mode of operation of the valve operating mechanism shown in FIGS. 14 and 15. For medium-speed engine operation, the first and second rocker arms 7, 8 are disconnected, whereas the first and third rocker arms 7, 9 are interconnected. Now, the intake valve 1*a* alternately opens and closes the intake port at the valve timing and valve lift according to the profile of the first low-speed cam 40, and the other intake valve 1*b* alternately opens and closes the intake port at the valve timing and valve lift according to the profile of the high-speed cam 5.

While the intake valves 1*a*, 1*b* are shown as being operated by each of the valve operating mechanisms, exhaust valves may also be operated by the valve operating mechanisms according to the present invention. In such a case, unburned components due to exhaust gas turbulence can be reduced in low-speed operation of the engine, whereas high engine output power and torque can be generated by reducing resistance to the flow of an exhaust gas from the combustion chamber in high-speed operation of the engine.

Although certain preferred embodiments have been shown and described, it should be understood that many changes and modifications may be made therein without departing from the scope of the appended claims.

We claim:

1. A valve operating mechanism for operating a pair of valves of an internal combustion engine, comprising:
   - a camshaft rotatable in synchronism with rotation of the internal combustion engine and having a plurality of cams of different cam profiles;
   - a plurality of rocker arms held in sliding contact with said cams, respectively, for operating the valves according to the cam profiles of said cams; and
   - means for independently selectively interconnecting and disconnecting selected of said rocker arms to operate the valves at different valve timings in low, medium and high speed ranges of the internal combustion engine.

2. A valve operating mechanism according to claim 1, wherein said cams include a low-speed cam and a high-speed cam having a cam lobe larger than a cam lobe of said low-speed cam, said camshaft also having a circular raised portion corresponding to a base circle of said low- and high-speed cams, said high-speed cam being disposed between said low-speed cam and said raised portion, said rocker arms including first, second, and third rocker arms slidably held against said high-speed cam, said low-speed cam, and said raised portion, respectively, said second and third rocker arms having ends for engagement with said intake valves, respectively.

3. A valve operating mechanism according to claim 2, wherein said means comprises a first selective coupling operatively disposed in and between said first and second rocker arms for selectively interconnecting and disconnecting the first and second rocker arms, and a second selective coupling operatively disposed in and between said first and third rocker arms for selectively interconnecting and disconnecting the first and third rocker arms, said first and second selective couplings being operable independently of each other.

4. A valve operating mechanism according to claim 3, wherein said first selective coupling comprises a first guide hole defined in said first rocker arm, a second guide hole defined in said second rocker arm in registration with said first guide hole, a first piston slidably fitted in said first guide hole, a first spring disposed in said second guide hole for normally urging said first piston into said first guide hole, and first means for applying hydraulic pressure to said first piston to move the same to a position between said first and second guide holes against the resiliency of said first spring, said second selective coupling comprises a third guide hole defined in said first rocker arm, a fourth guide hole defined in said third rocker arm in registration with said third guide hole, a second piston slidably fitted in said third guide hole, a second spring disposed in said fourth guide hole for normally urging said second piston into said third guide hole, and second means for applying hydraulic pressure to said second piston to move the same to a position between said third and fourth guide holes against the resiliency of said second spring.

5. A valve operating mechanism according to claim 2, including lifter means for normally urging said first rocker arm resiliently into sliding contact with said high-speed cam.

6. A valve operating mechanism according to claim 1, wherein said cams include a low-speed cam and a high-speed cam having a cam lobe larger than a cam lobe of said low-speed cam, said camshaft also having a circular raised portion corresponding to a base circle of said low-and high-speed cams and disposed between said low-speed cam and said high-speed cam, said rocker arms including first, second, and third rocker arms slidably held against said raised portion, said low-speed cam, and said high-speed cam, respectively, said first and second rocker arms having ends for engagement with said intake valves, respectively.

7. A valve operating mechanism according to claim 6, wherein said means comprises a first selective coupling operatively disposed in and between said first and second rocker arms for selectively interconnecting and disconnecting the first and second rocker arms, and a second selective coupling operatively disposed in and between said first and third rocker arms for selectively interconnecting and disconnecting the first and third rocker arms, said first and second selective couplings being operable independently of each other.

8. A valve operating mechanism according to claim 7, wherein said first selective coupling comprises a first guide hole defined in said first rocker arm, a second guide hole defined in said second rocker arm in registration with said first guide hole, a first piston slidably fitted in said first guide hole, a first spring disposed in said second guide hole for normally urging said first piston into said first guide hole, and first means for applying hydraulic pressure to said first piston to move the same to a position between said first and second guide holes against the resiliency of said first spring, said second selective coupling comprises a third guide hole defined in said first rocker arm, a fourth guide hole defined in said third rocker arm in registration with said third guide hole, a second piston slidably fitted in said third guide hole, a second spring disposed in said fourth guide hole for normally urging said second piston into said third guide hole, and second means for applying hydraulic pressure to said second piston to move the same to a position between said third and fourth guide holes against the resiliency of said second spring.

9. A valve operating mechanism according to claim 6, including lifter means for normally urging said third rocker arm resiliently into sliding contact with said high-speed cam.

10. A valve operating mechanism according to claim 1, wherein said cams include a first low-speed cam, a second low-speed cam having a cam lobe of a different profile from the profile of a cam lobe of said first slow-speed cam, and a high-speed cam having a cam lobe larger than the cam lobes of said first and second low-speed cams and disposed between said first and second low-speed cams, said rocker arms including first, second, and third rocker arms slidably held against said high-speed cam, said first low-speed cam, and said second low-speed cam, respectively, said second and third rocker arms having ends for engagement with said intake valves, respectively.

11. A valve operating mechanism according to claim 10, wherein said means comprises a first selective coupling operatively disposed in and between said first and second rocker arms for selectively interconnecting and disconnecting the first and second rocker arms, and a second selective coupling operatively disposed in and between said first and third rocker arms for selectively interconnecting and disconnecting the first and third rocker arms, said first and second selective couplings being operable independently of each other.

12. A valve operating mechanism according to claim 11, wherein said first selective coupling comprises a first guide hole defined in said first rocker arm, a second guide hole defined in said second rocker arm in registration with said first guide hole, a first piston slidably fitted in said first guide hole, a first spring disposed in said second guide hole for normally urging said first piston into said first guide hole, and first means for applying hydraulic pressure to said first piston to move the same to a position between said first and second guide holes against the resiliency of said first spring, said second selective coupling comprises a third guide hole defined in said first rocker arm, a fourth guide hole defined in said third rocker arm in registration with said third guide hole, a second piston slidably fitted in said third guide hole, a second spring disposed in said fourth guide hole for normally urging said second piston into said third guide hole, and second means for applying hydraulic pressure to said second piston to move the same to a position between said third and fourth guide holes against the resiliency of said second spring.

13. A valve operating mechanism according to claim 10, including lifter means for normally urging said first rocker arm resiliently into sliding contact with said high-speed cam.

14. A valve operating mechanism for operating valve means of an internal combustion engine, comprising:

a camshaft rotatable in synchronism with rotation of said engine;

a plurality of driver rocker arms operably connecting said valve means to open and close said valve means in accordance with a desired mode of operation, and a free rocker arm adjacent each of said driver rocker arms;

a plurality of cams on said camshaft, each engaging one of said rocker arms and each having a cam profile effective to impart a desired mode of operation to said valve means;

means for selectively interconnecting and disconnecting said rocker arms including couplings operative between adjacent pairs of rocker arms; and means for independently actuating each said coupling.

15. A valve operating mechanism according to claim 14 in which said couplings are hydraulically actuated; and means for supplying operating fluid independently to each said coupling.

16. A valve operating mechanism according to claim 15 including a rocker shaft mounting said rocker arms for pivotal movement; and means in said rocker shaft defining an independent fluid supply passage to each said coupling.

17. A valve operating mechanism according to claim 16 in which said rocker shaft contains an axial opening therethrough; partition means in said opening defining separate fluid supply passages; and means for connecting each said supply passage with each said coupling.

18. A valve operating mechanism according to claim 17 in which said valve means includes a pair of valves; a driver rocker arm operably connecting each of said valves; and said free rocker arm being interposed between said driver rocker arms.

* * * * *